United States Patent [19]

Krone

[11] Patent Number: 4,825,960

[45] Date of Patent: May 2, 1989

[54] SYNCHRONIZED HYDRAULIC HAMMER ARRANGEMENT

[75] Inventor: John J. Krone, Dunlap, Ill.

[73] Assignee: Caterpillar Inc., Peoria, Ill.

[21] Appl. No.: 213,742

[22] Filed: Jun. 30, 1988

[51] Int. Cl.[4] ..... B25D 9/00

[52] U.S. Cl. ..... 173/51; 173/134; 91/281

[58] Field of Search ..... 173/50, 51, 101, 119, 173/134; 91/281

[56] References Cited

U.S. PATENT DOCUMENTS 4,034,817 7/1977 Okada ..... 173/134

4,715,265 12/1987 Graul et al. ..... 91/170

*Primary Examiner*—Frank T. Yost

*Assistant Examiner*—James L. Wolfe

*Attorney, Agent, or Firm*—John W. Grant

[57] ABSTRACT

Hydraulic hammers are useful for transmitting high impact blows to a tool for fracturing hard material. When two hammers are used in combination the impact blows delivered to a common tool by the hammers should be synchronized for maximum effectiveness. The subject synchronized hydraulic hammer arrangement includes a valve arrangement for alternately directing pressurized fluid to a variable volume chamber in each of a pair of hydraulic hammers to simultaneously retract a piston of each hydraulic hammer against the bias of pressurized gas in a gas chamber of each hydraulic hammer and exhausting the variable volume hydraulic chambers in response to at least one of the pistons reaching a predetermined position. The gas chambers are interconnected for equalizing the gas pressure therein. This arrangement of components provides synchronized movement of the pistons in an outward direction so that they simultaneously impact against the common tool.

10 Claims, 1 Drawing Sheet

SYNCHRONIZED HYDRAULIC HAMMER ARRANGEMENT

TECHNICAL FIELD

This invention relates generally to a control for a pair of hydraulic hammers and more particularly to a synchronized hydraulic hammer arrangement for providing synchronous actuation of the pair of hydraulic hammers.

BACKGROUND ART

Hydraulic hammers are commonly used to deliver high energy impact blows to a tool for fracturing rock, coal, shale, cement, and so forth. One example of such use involves positioning a hydraulic hammer relative to a ripper shank wherein the impact blows are delivered to the shank and thus to the ripper tip and the material being ripped. In another example, it has been proposed to position a pair of hammers beneath a floor of a bucket to deliver impact blows to a cutting edge reciprocally movably connected to the bucket at the leading edge thereof. By using two hydraulic hammers rather than one central mounted hammer, overhanging externally applied loads can be better supported. In addition, packaging of the bucket design is more compact when two smaller hammers providing the same impact energy as a single larger hammer are used. One of the problems associated with such an arrangement having two hydraulic hammers delivering impact blows to a common tool is that the impact blows should be delivered to the cutting edge simultaneously for maximum effectiveness and to minimize the force differential in the common tool.

The present invention is directed to overcoming one or more of the problems as set forth above.

DISCLOSURE OF THE INVENTION

In one aspect of the present invention a synchronized hydraulic hammer arrangement includes a pair of hydraulic hammers each having a housing, a piston slidably positioned in the housing and having a pair of fluid engagement surfaces thereon, a variable volume gas chamber defined by the housing and one of the fluid engagement surfaces and filled with a pressurized gas, and a variable volume hydraulic chamber defined by the housing and the other of the fluid engagement surfaces. A valve means is connected to the variable volume hydraulic chamber and is connectable to a source of pressurized fluid. The valve means is operative to alternately direct pressurized fluid into the hydraulic chambers to retract the piston against the bias of the pressurized gas and to exhaust the hydraulic chambers of both hydraulic hammers in response to at least one of the pistons reaching a predetermined position. A means interconnecting the gas chambers is provided for equalizing the gas pressure therein.

The present invention provides a synchronized hydraulic hammer arrangement which synchronizes the actuation of a pair of hydraulic hammers so that the impact blows of the hammers are simultaneously delivered to a common tool. The arrangement includes interconnecting the gas chambers of both hydraulic hammers so that the pressure of the compressed gas therein is substantially equal at all operating conditions of the hydraulic hammers. The valve means is operative to cause both pistons to be retracted against the bias of the compressed gas and to exhaust the hydraulic chambers of both hydraulic hammers when at least one of the pistons reaches a predetermined position. Thus both pistons are extended in unison by the force exerted by the compressed gas.

BEST MODE FOR CARRYING OUT THE INVENTION

Figure 1:
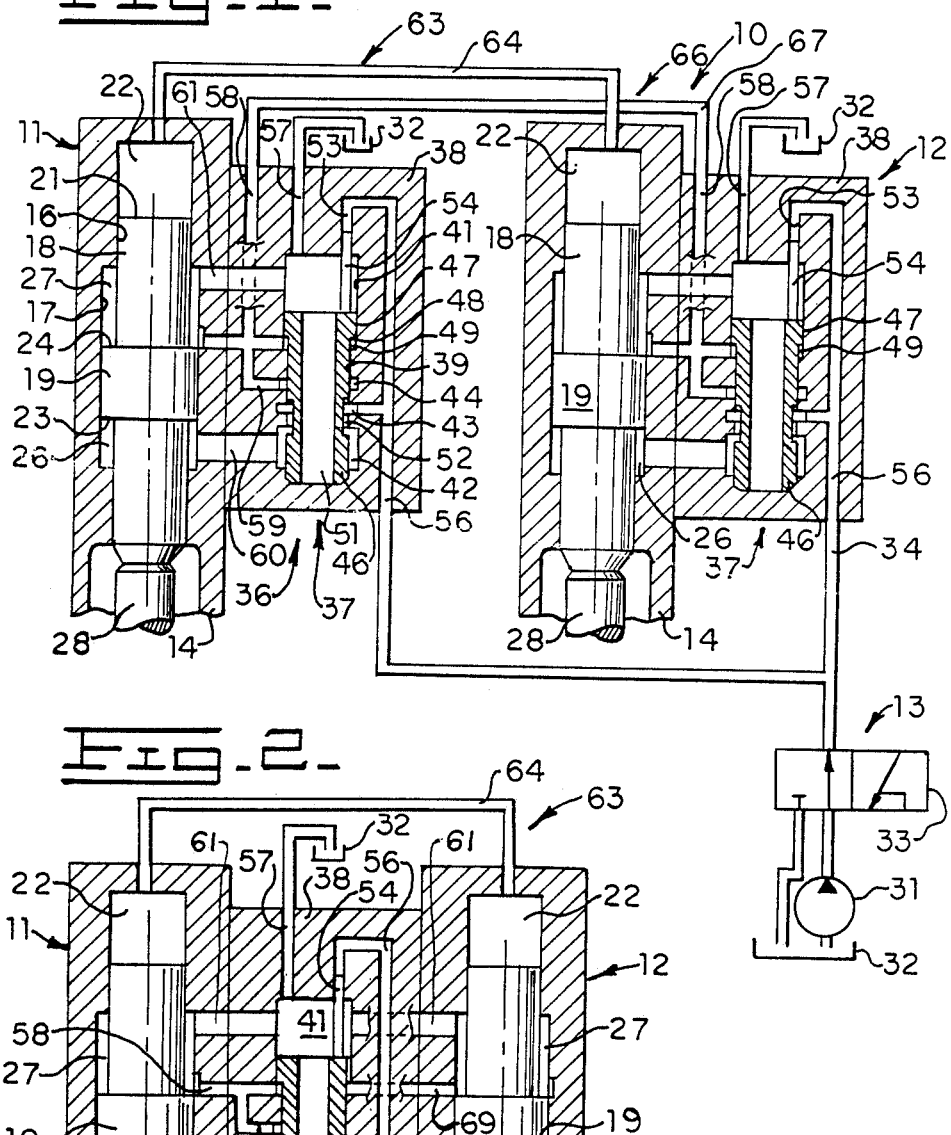
FIG. 1 is a diagrammatic illustration of an embodiment of the present invention with portions shown in cross section for illustrative convenience.

Referring to FIG. 1, a synchronized hydraulic hammer arrangement 10 includes a pair of hydraulic hammers 11,12 operatively connected to a source of pressurized fluid 13.

The hammers 11,12 are identical and thus only the hammer 11 will be described in detail with common reference numerals generally applied to both the hammers. The hammer 11 includes a housing 14 having a longitudinally extending stepped bore 16 with the bore 16 having an enlarged intermediate section 17. A piston 18 is slidably disposed in the bore 16 and has a flange 19 slidably disposed within the enlarged intermediate section 17. The piston 18 has an end surface 21 which functions as a fluid engagement surface and cooperates with the housing 14 to define a variable volume gas chamber 22. The flange 19 has a pair of annular shoulders 23,24 which function as fluid engagement surfaces and cooperate with the housing to define a pair of annular variable volume hydraulic chambers 26,27 respectively at opposite ends of the flange. The hydraulic hammer 11 includes an impact transfer member 28 positioned to receive impact blows from the piston 18. The members 28 of the hammers 11,12 are connected to a common work tool, not shown. The gas chambers 22 are filled with a pressurized gas in the usual manner.

The source of pressurized hydraulic fluid 13 includes a pump 31 connected to a reservoir 32, a control valve 33 connected to the pump 31 and a supply conduit 34 connected to the control valve 33. The control valve 33 is movable between a first position at which the pressurized fluid is directed from the pump 31 into the supply conduit 34 and a second position at which the pump 31 and supply conduit 34 are communicated with the reservoir 32.

The arrangement 10 includes a valve means 36 connected to the supply conduit 34 and to the hydraulic chambers 26 of the hydraulic hammers 11,12 and is operative for alternately directing pressurized fluid into the hydraulic chambers 26 to retract the pistons 18 against the bias of the pressurized gas and for exhausting the hydraulic chambers 26 in response to the pistons reaching a predetermined retracted position. The valve means 36 can be, for example, as disclosed in the embodiment of FIG. 1 a pair of actuating valves 37 each being associated with one of the hydraulic hammers 11,12.

The actuating valves 37 are identical and only the valve 37 associated with the hammer 11 will be described in detail with the description applying to both valves 37. The valve 37 includes a body 38 connected to the housing 14 in the usual manner. The body 38 has a stepped bore 39 with the bore having an enlarged end section 41. A plurality of annuluses 42,43,44 communicate with and are axially spaced along the stepped bore 39. A valve spool 46 is slidably positioned in the bore 39 and has a flange 47 slidably disposed in the respective enlarged end section 41. The flange 47 has an annular shoulder 48 which functions as an actuating surface and cooperates with the body 38 to define an annular actuating chamber 49. The valve spool 46 has a longitudinally extending axially disposed passage 51 therein and an annular groove 52 formed on the outer periphery thereof. The body 38 has a bore 53 opening into the bore 41 at one side thereof. A plunger 54 is slidably disposed in the bore 53 and abuts the valve spool 46. The effective area of the annular shoulders 48 is greater than the effective area of the plungers. The body 38 also includes an inlet port 56 connected to the supply conduit 34 and being in communication with the annulus 43 and the bore 53. An exhaust port 57 connects the enlarged end section 41 with the reservoir 32. A signal port 58 is formed partially in the body 38 and partially in the housing 14 and is in continuous communication with the actuating chamber 49. Depending upon the position of the piston 18, the signal port 58 is also either in communication with the hydraulic chamber 27, blocked by the flange 19 of the piston 18 or is in communication with the hydraulic chamber 26. A signal passage 59 connects the annulus 43 with the signal port 58. A transverse passage 60 jointly formed in the body 38 and the housing 14 communicates the annulus 42 with the hydraulic chamber 26 while another transverse passage 61 communicates the hydraulic chamber 27 with the enlarged end section 41. The valve spool 46 is movable between first and second positions. At the first position, the spool 46 communicates the inlet port 56 with the hydraulic chamber 26, blocks the inlet port from the annulus 44 and blocks the hydraulic chamber 26 from the exhaust port 57. At the second position, the hydraulic chamber 26 is in communication with the exhaust port 57 and the inlet port 56 is in communication with the annulus 44.

The arrangement 10 also includes a means 63 interconnecting the gas chambers 22 of the hydraulic hammers 11,12 for equalizing the gas pressure in the gas chambers. Such means can include, for example, a conduit 64 interconnecting the gas chambers.

The arrangement 10 further includes a means 66 for simultaneously moving both valve spools 46 to their second position in response to one of the pistons 18 reaching the predetermined position. Such means 66 can include, for example, a signal conduit 67 interconnecting the signal ports 58 of both actuating valves 37.

Figure 2:
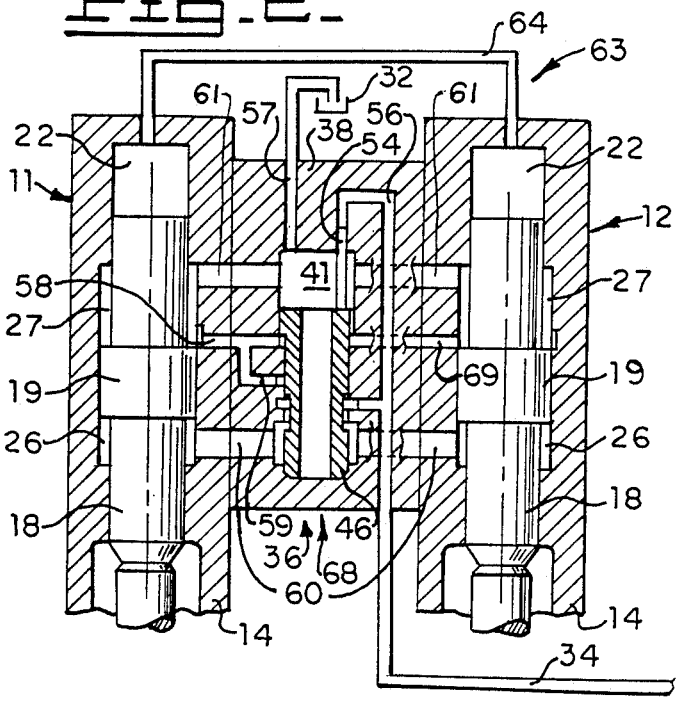
FIG. 2 is a diagrammatic illustration of an alternate embodiment.

An alternate embodiment of a synchronized hydraulic hammer arrangement 10 of the present invention is disclosed in FIG. 2. It is noted that the same reference numerals of the first embodiment are used to designate similarly constructed counterpart elements of this embodiment. In this embodiment however, the valve means 36 includes a single actuating valve 68 similar in construction to the above described actuating valves 37 but is operationally associated with both of the hammers 11,12. In this embodiment, a pair of transverse passages 60 are jointly formed in the body 38 and the housings 14 of the hydraulic hammers 11,12 for communicating the annulus 42 with the hydraulic chambers 26 of both hydraulic hammers. Similarly, a pair of transverse passages 61 are jointly formed in the body 38 and the housings 14 to communicate the chambers 27 of both hydraulic hammers with the enlarged section 41 of the bore 39. In addition to the signal passage 58, another signal passage 69 is jointly formed in the body 38 and the housing 14 of the hydraulic hammer 12. The signal passage 69 either communicates the actuating chamber 49 with the annular chamber 27 of the hydraulic hammer 12, is blocked by the flange 19 on the piston 18 of the hydraulic actuator 12 or communicates the hydraulic chamber 26 of the hydraulic hammer 12 with the actuating chamber 49.

INDUSTRIAL APPLICABILITY

In the use of the embodiment of FIG. 1, the pistons 18 of the hydraulic hammers 11,12 and the valve spools 46 of the actuating valves 37 are shown in the extended position they would occupy immediately after the pistons 18 have impacted against the members 28. Thus, with the control valve 33 in the position shown pressurized hydraulic fluid from the pump 31 is transmitted through the supply conduit 34, the inlet ports 56, the annuluses 43, the annular grooves 52, the annuluses 42, and the transverse passages 60 and into the hydraulic chambers 26. The hydraulic pressure acting on the annular shoulders 23 retracts the pistons 18 thereby compressing the gas in the chambers 22. Since the gas chambers 22 are interconnected through the conduit 64 and the hydraulic chambers 26 are receiving fluid from a common source, the travel rate of the pistons 18 will be identical, or at least substantially identical. As the pistons 18 retract the hydraulic fluid contained in the hydraulic chambers 27 is exhausted through the transverse passages 61, the enlarged section 41, and the exhaust port 57 to the reservoir 32. Under optimum conditions the pistons 18 simultaneously reach a predetermined position at which the annular shoulders 23 clear the signal ports 58 to establish communication between the hydraulic chambers 26 and the signal ports 58. High pressure hydraulic fluid is transmitted from the hydraulic chambers 26 into the actuating chambers 49 where it acts against the annular shoulders 48 of the valve spools 46, and simultaneously moves the valve spools 46 to their second positions. With the valve spools in the second positions the stored energy in the compressed gas in the gas chambers 22 rapidly propels the pistons 18 outwardly in synchronization against the impact members 28. The fluid in the hydraulic chambers 26 passes through the transverse passages 60, the central passages 51 in the valve spools 46, and the transverse passages 61 to fill the expanding chambers 27 behind the moving pistons, in response to the outward movement of the pistons 18. Any excess fluid passes through the exhaust ports 57 to the reservoir 32. During the outward movement of the pistons 18, the flanges 19 block communication between the signal ports 58 and the enlarged sections 17 of the bores 16 so that pressurized fluid in the annuluses 43 is transmitted into the actuating chambers 49 to hold the valve spools 46 in their second positions. When the annular shoulders 24 passes the opening of the signal ports 58, communication is established between the actuating chambers 49 and the reservoir 32. The size of the signal passage 59 is selected to restrict fluid flow therethrough to create back pressure in the inlet ports 56 and the bores 53 sufficient to cause the plungers 54 to move the valve spools 46 to their first positions. The above cycle is then repeated so long as the control valves 33 remain in the position shown.

In actuality, however, the above described optimum condition wherein the pistons 18 simultaneously reach the predetermined position does not always occur. Assume, for example, that the piston 18 of the hydraulic hammer 11 may be in a slightly retracted position at the beginning of the retraction cycle due to a difference in external loading on the members 58. Under this condition that piston leads the piston 18 of the hydraulic hammer 12 and will reach its predetermined position before the piston 18 of the hydraulic hammer 12 reaches its predetermined position. When this happens the pressurized fluid from the hydraulic chamber 26 of the hydraulic hammer 11 is simultaneously transmitted to the actuating chambers 49 of both actuating valves 37 through the signal conduit 67. Thus, both valve spools 46 are moved in unison to their second positions. As previously described this allows the compressed gas in the gas chambers 22 to rapidly propel the pistons 18 outwardly so they simultaneously impact against the members 28.

The basic operation of the alternate embodiment of FIG. 2 is similar to that described above with the difference being that actuation of the pistons 18 of both hydraulic hammers 11,12 is controlled by a single actuating valve 68. Thus, at the beginning of the cycle, pressurized hydraulic fluid passes through both transverse passages 60 into the hydraulic chambers 26 to cause simultaneous retraction of the pistons 18 against the bias of the compressed gas in the gas chambers 22. When one or both of the pistons 18 reaches the predetermined position at which communication is established between the hydraulic chamber(s) 26 and the actuating chamber 49, pressurized fluid is transmitted to the actuating chamber to move the valve spool 46 to its second position. This simultaneously communicates the hydraulic chambers 26 of both hydraulic hammers to the reservoir 32 so that the pistons 18 of both hydraulic hammers are rapidly propelled outwardly in unison against the members 28. When the pistons reach the extended positions, the valve spool 46 is moved to its first position as described above and the cycle is repeated as long as the valve 33 remains in the position shown.

In view of the forgoing, it is readily apparent that the structure of the present invention provides a synchronized hydraulic hammer arrangement which provides synchronized movement of the pistons in an outward direction so that they simultaneously impact against the impact members. With the impact members being connected to a common work tool, the impact energy of the pistons of both hydraulic hammers will be delivered to the work tool simultaneously so that the maximum effectiveness of the impact blows is utilized.

Other aspects, objects and advantages of this invention can be obtained from a study of the drawing, the disclosure and the appended claims.

I claim:

1. A synchronized hydraulic hammer arrangement comprising:

a pair of hydraulic hammers each having a housing, a piston slidably positioned in the housing and having a pair of fluid engagement surfaces thereon, a variable volume gas chamber defined by the housing and one of the fluid engagement surfaces and filled with a pressurized gas, and a variable volume hydraulic chamber defined by the housing and the other of the fluid engagement surfaces;

valve means connected to the variable volume hydraulic chambers and being connectable to a source of pressurized fluid for alternately directing pressurized fluid from the source of pressurized fluid into the hydraulic chambers to simultaneously retract the pistons against the bias of the pressurized gas and exhausting the hydraulic chambers in response to at least one of the pistons reaching a predetermined position; and means interconnecting the gas chambers for equalizing the gas pressure therein.

2. The synchronized hydraulic hammer arrangement of claim 1 wherein said valve means includes a pair of actuating valves individually connected to the hydraulic chambers, each of the valves including an inlet port, an exhaust port and a spool movable between a first position at which the inlet port is in communication with the associated hydraulic chamber and a second position at which the respective hydraulic chamber is in communication with the exhaust port, said arrangement including means for simultaneously moving the valve spools to their second positions in response to the one piston reaching the predetermined position.

3. The synchronized hydraulic hammer arrangement of claim 2 wherein each of the valve spools has an actuating surface thereon and each of said actuating valves includes an actuating chamber defined in part by the actuating surface of the valve spool and a signal port connected to the actuating chamber of the actuating valve and to the hydraulic chamber when the piston is at the predetermined position, said moving means includes a signal conduit interconnecting the actuating chambers of both actuating valves.

4. The synchronized hydraulic hammer arrangement of claim 1 wherein said valve means includes an actuating valve connected to the hydraulic chambers of both hydraulic hammers, said valve having an inlet port, an exhaust port, and a valve spool movable between a first position at which the inlet port is in communication with both hydraulic chambers and a second position at which said hydraulic chambers are in communication with the exhaust port, said arrangement including means for moving the valve spool to its second position in response to the one piston reaching the predetermined position.

5. The synchronized hydraulic hammer arrangement of claim 4 wherein said valve spool has an actuating surface thereon and said actuating valve includes an actuating chamber defined in part by the actuating surface of the valve spool, and a signal port connected to the actuating chamber of the actuating valve and being in communication with the hydraulic chamber associated with the one piston when that piston is at the predetermined position.

6. A synchronized hydraulic hammer arrangement comprising:

a pair of hydraulic hammers each having a housing, a piston slidably positioned in the housing and having a pair of fluid engagement surfaces thereon, a variable volume gas chamber defined by the housing and one of the fluid engagement surfaces and filled with a pressurized gas, and a variable volume hydraulic chamber defined by the housing and the other of the fluid engagement surfaces;

a pair of actuating valves individually connected to the hydraulic chambers, each of the actuating valves including an inlet port, an exhaust port, and a spool movable between a first position at which the inlet port is in communication with the associated hydraulic chamber and a second position at which the respective hydraulic chamber is in communication with the exhaust port; and means for simultaneously moving the valves spools to the second positions in response to one of the pistons reaching a predetermined position.

7. The synchronized hydraulic hammer arrangement of claim 6 wherein each of the valve spools has an actuating surface thereon and each of said actuating valves includes an actuating chamber defined in part by the actuating surface of the valve spool and a signal port connected to the actuating chamber of the actuating valve and to the hydraulic chamber when the piston is at the predetermined position, said moving means includes a signal conduit interconnecting the signal ports of both actuating valves.

8. The synchronized hydraulic hammer arrangement of claim 7 including a conduit interconnecting the gas chambers.

9. A synchronized hydraulic hammer arrangement of comprising:

a pair of hydraulic hammers each having a housing, a piston slidably positioned in the housing and having a pair of fluid engagement surfaces thereon, a variable volume gas chamber defined by the housing and one of the fluid engagement surfaces and filled with a pressurized gas, and a variable volume hydraulic chamber defined by the housing and the other of the fluid engagement surfaces;

an actuating valve connected to the hydraulic chambers of both hydraulic hammers, said actuating valve having an inlet port, an exhaust port and a valve spool movable between a first position at which the inlet port is in communication with both hydraulic chambers and a second position at which said hydraulic chambers are in communication with the exhaust port, and a pair of signal ports connected to the actuating chamber with one of the signal ports being in communication with one of the hydraulic chambers when the piston associated with that hydraulic chamber reaches a predetermined position.

10. The synchronized hydraulic hammer arrangement of claim 9 including a conduit interconnecting the gas chambers.

* * * * *